US007007704B2

(12) United States Patent
Luckstead

(10) Patent No.: US 7,007,704 B2
(45) Date of Patent: Mar. 7, 2006

(54) CONVERTIBLE WALKING AID

(76) Inventor: David G. Luckstead, 4602 Janssen, Corpus Christi, TX (US) 78411

( * ) Notice: Subject to any disclaimer, the term of this patent is extended or adjusted under 35 U.S.C. 154(b) by 405 days.

(21) Appl. No.: 10/039,097

(22) Filed: Jan. 2, 2002

(65) Prior Publication Data

US 2003/0205266 A1 Nov. 6, 2003

(51) Int. Cl.
*A61H 3/02* (2006.01)
*A45B 3/00* (2006.01)
*A45B 9/00* (2006.01)

(52) U.S. Cl. ..... 135/65; 135/66; 135/68; D3/37

(58) Field of Classification Search ..... 135/76, 135/65, 66, 68, 69; D3/7, 8; 403/353
See application file for complete search history.

(56) References Cited

U.S. PATENT DOCUMENTS

| | | | | | |
|---|---|---|---|---|---|
| 432,759 | A | * | 7/1890 | Minniss | 135/66 |
| 433,016 | A | * | 7/1890 | Minniss | 135/66 |
| 1,375,912 | A | | 4/1921 | Huddle | |
| 2,208,195 | A | * | 7/1940 | Paul | 135/68 |
| 2,388,374 | A | * | 11/1945 | Tracy | 135/72 |
| 2,734,554 | A | | 2/1956 | Ries | |
| 3,032,048 | A | * | 5/1962 | Hoffmann | 135/71 |
| 3,208,461 | A | * | 9/1965 | Irwin | 135/69 |
| 4,556,075 | A | | 12/1985 | Hoffman | |
| 5,339,849 | A | | 8/1994 | Stutz | |
| 5,351,704 | A | * | 10/1994 | Hunnicutt et al. | 135/66 |
| 6,206,019 | B1 | | 3/2001 | Horvitz | |
| 6,561,206 | B1 | * | 5/2003 | Wilkinson | 135/65 |

FOREIGN PATENT DOCUMENTS

| | | | |
|---|---|---|---|
| DE | 1090377 | * | 10/1960 |
| DE | 3530387 A1 | * | 2/1987 |
| FR | 2589694 | * | 5/1987 |
| WO | WO 8900039 A1 | * | 1/1989 |
| WO | WO 9217142 | | 10/1992 |

* cited by examiner

*Primary Examiner*—Robert Canfield
(74) *Attorney, Agent, or Firm*—G. Turner Moller

(57) ABSTRACT

A convertible cane assembly comprises a pair of canes which can be used separately by a cane user. The canes include connections for securing the canes in side-by-side relation to provide a single cane which can be used in a normal manner. An important feature of the connections is the ability to easily separate the canes. In the single cane version, loads are preferably transferred through the entire length of both canes, meaning that the connections do not have to carry substantial loads.

17 Claims, 2 Drawing Sheets

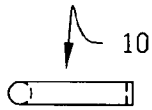
FIG.3
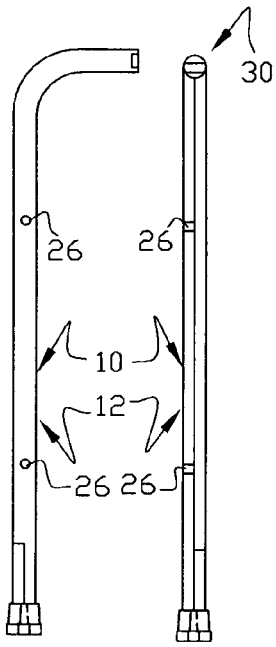
FIG.1 FIG.2
FIG.4
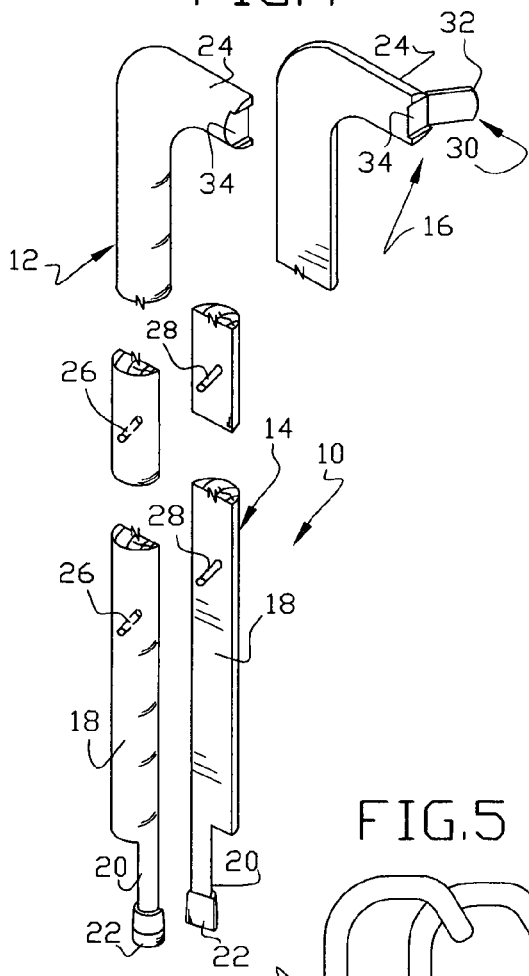
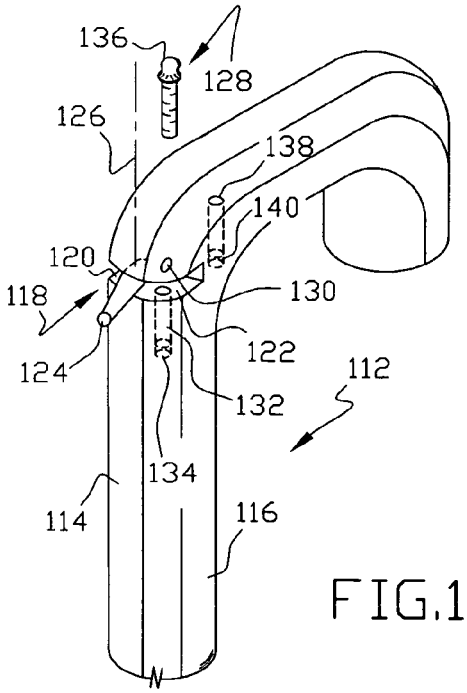
FIG.11
FIG.5
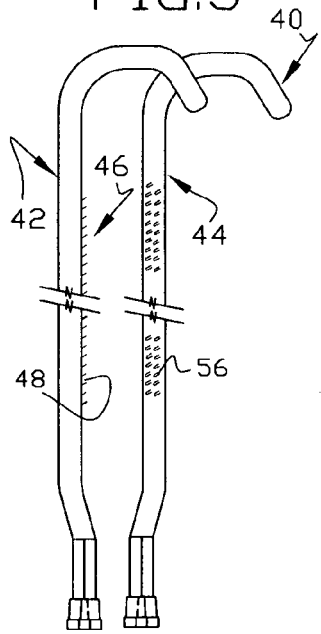

CONVERTIBLE WALKING AID

This invention is a walking aid which can be readily converted from a single cane into a pair of canes.

BACKGROUND OF THE INVENTION

Those who walk with a cane often find themselves in a situation where it would be desirable to have two canes, one for each hand. For example, it is often difficult for a cane user to negotiate a curb with a single cane and much easier if the person has a cane in each hand. Other similar situations will be apparent and are well known to cane users. In response to this need, it has been proposed to provide a hollow cane which houses a second cane on the inside as shown in U.S. Pat. Nos. 1,375,912 and 4,556,075. A major disadvantage of this approach is that the inner cane does not, and almost inherently cannot, have an enlarged rubber foot which promotes traction with the underlying surface.

In another situation, it is often desirable for a person who habitually uses two walking aids to join them together so they are more easily stowed when not in use. In response to this situation, crutches and other walking aids are joined together for stowage as shown in U.S. Pat. No. 5,339,849 and EPO application WO 92/17142.

Other disclosures of interest relative to this invention are found in U.S. Pat. Nos. 2,734,554 and 6,206,019.

SUMMARY OF THE INVENTION

In this invention, a single more-or-less conventional appearing cane is readily broken apart into a pair of canes of sufficient size and strength to provide a cane for each hand of a cane user. Often, a cane user wants to have an additional cane under adverse conditions, e.g. in a poorly lit area when it is cold and raining. Accordingly, an important feature of this invention is the ability to separate the two canes in an easy manner so the canes can be used separately.

When it is desired to use only a single cane, the two canes are attached together in a side-by-side relation to provide a cane assembly. Preferably, the handle of the single cane assembly comprises the two abutted handles of the separate canes and the foot of the single cane assembly comprises the two abutted feet of the separate canes. An important advantage of the side-by-side relationship of the canes is that both canes can be provided with resilient feet. In preferred embodiments of this invention, the load imparted to the single cane by the user is supported by both canes so essentially no load is placed on the connecting mechanism.

It is an object of this invention to provide an improved convertible cane assembly.

A further object of this invention is to provide an improved cane assembly which can be used as a single cane and which is readily disassembled to provide two separate canes.

A more specific object of this invention is to provide a convertible cane assembly having a pair of canes connected in side-by-side abutting relation which can be used as a single cane.

Another object of this invention is to provide a method of using a convertible cane assembly.

These and other objects and advantages of this invention will become more apparent as this description proceeds, reference being made to the accompanying drawings and appended claims.

BRIEF DESCRIPTION OF THE DRAWINGS

FIG. 1 is a side elevational view of a convertible cane of this invention, illustrated in a single cane configuration;

FIG. 2 is a end view of the convertible cane of FIG. 1;

FIG. 3 is a top view of the convertible cane of FIGS. 1 and 2;

FIG. 4 is an exploded isometric view of the convertible cane of FIGS. 1–3;

FIG. 5 is an exploded isometric view of another embodiment of this invention;

FIG. 11 is an enlarged isometric view of another embodiment of this invention.

DETAILED DESCRIPTION

Figure 6:
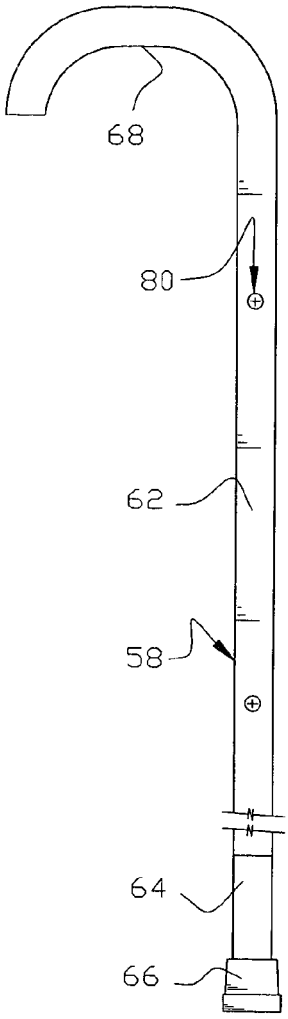
FIGS. 6 and 7 are views of the inside of another embodiment of this invention, illustrating a different type of connection.

Referring to FIGS. 1–4, a convertible cane assembly 10 of this invention comprises a pair of side-by-side canes 12, 14 which are joined together by a releasable connection 16 so the cane assembly 10 can be used as a single cane, or the canes 12, 14 can be used separately and simultaneously. The canes 12, 14 are of generally conventional appearing construction and each comprise a sturdy upright support 18, a foot 20 having a resilient pad 22 adjacent the bottom of the support 18 and a handle 24 adjacent the upper end of the support 18. The resilient pad 22 is of a conventional type used for canes and is typically made of dry natural rubber. The resilient pad 22 is as large as is reasonable and is preferably at least half the cross-sectional area of the upright support 18. It is preferred that the load imparted by the cane user to the cane assembly 10 be sustained by both canes 12, 14 so that no substantial force is imparted through the connection 16.

The connection 16 may be of any suitable type commensurate with its desired functions, which include the ability to keep the canes 12, 14 together when so desired while providing the ability to separate the canes 12, 14 in an easy and expeditious manner. One embodiment of the connection 16 is shown in FIGS. 1–4 where the cane 12 provides a pair of vertically spaced inclined passages 26 receiving inclined pegs 28 provided by the cane 14. The pegs 28 and passages 26 prevent the canes 12, 14 from separating so long as there is no relative vertical movement between the canes 12, 14.

The connection 16 also includes a device 30 selectively preventing vertical movement between the canes 12, 14 in the form of a tab 32 pivoted to the cane 14 for movement into a pair of aligned grooves 34 in the ends of the handles 24. The tab 32 and grooves 34 are sized to fit snugly. With the canes 12, 14 in a side-by-side abutting relation so the pegs 28 fit into the inclined passages 26 and with the tab 32 received in the grooves 34, the canes 12, 14 are joined together into the cane assembly 10 and can be used as a single cane.

When the case user desires to use two canes, the tab 32 is simply pivoted to the position shown in FIG. 4 and the canes 12, 14 shifted vertically as allowed by the inclined pegs 28 and passages 26. The canes 12, 14 accordingly separate in a simple efficient manner and can be simultaneously used as two separate canes. When the user desires to use only a single cane, the canes 12, 14 are connected together and the user grasps both handles 24 with a single hand. Accordingly, the handles 24 in the assembled position of FIGS. 1–3 is preferably not more than about 3" in diameter so it will fit easily into a user's hand. It will be seen that the bottoms of the resilient padded feet 22 are in a common plane so the load imparted by the user is applied more-or-less equally to both pads 22 thereby providing a more stable walking aid.

Referring to FIG. 5, another embodiment of this invention is illustrated where a convertible cane assembly 40 includes a pair of separate, generally mirror image canes 42, 44 which are releasably connected by a hook-and-loop fastener 46 comprising a strip of material having a multiplicity of hooks 48 on the cane 42 and a strip of material having a multiplicity of loops 50 on the cane 44.

Figure 7:
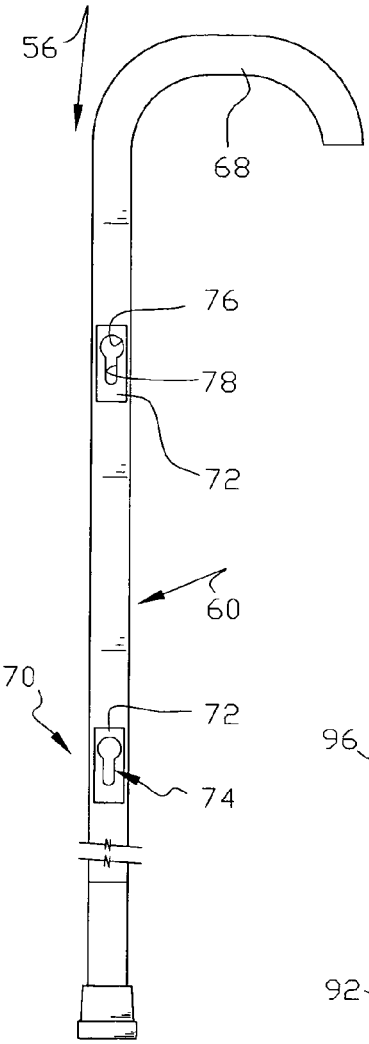

Referring to FIGS. 6–7, another convertible cane assembly 56 of this invention comprises a pair of canes 58, 60 each comprising an upright support 62, a foot 64 having a resilient pad 66 adjacent the bottom of the support 62 and a handle 68 adjacent the upper end of the support 62. The canes 58, 60 are slightly flattened on the side shown in FIGS. 6 and 7 so that, when connected, the cane assembly 56 appears generally round. A connection 70 secures the canes 58, 60 together when the user wants to use a single cane and allows the canes 58, 60 to separate for use separately and simultaneously.

Figure 8:
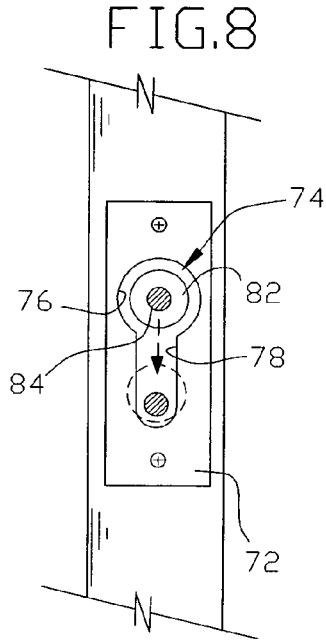
FIG. 8 is an enlarged view of the connection in the embodiment of FIGS. 6 and 7.

The connection 70 comprises a pair of vertically spaced metal brackets 72 on the cane 60 providing a key hole slot 74 having an enlarged generally circular upper end 76 and a narrow vertical slot 78. A pair of pins 80 on the cane 62 mate with the key hole slot 74 in a conventional manner. The pins 80 provide an enlarged head 82 and a smaller shank 84 so the enlarged head 82 passes through the upper end 76 of the key hole slot 74 as suggested in FIG. 8. With the enlarged head 82 received inside the upper end 76 of the slot 74, the canes 58, 60 are moved vertically relative to each other thereby moving the pins 80 downwardly in the slot 74 as suggested by the arrow and dashed lines in FIG. 8. It will be seen that the pins 80 may comprise a round headed screw with the head of a size between the slot 78 and the upper slot end 76. It will be seen that the enlarged heads 82 prevent horizontal relative movement between the canes 58, 60 while friction between the pins 80 and slot 74 controls relative vertical movement between the canes 58, 60.

Figure 9:
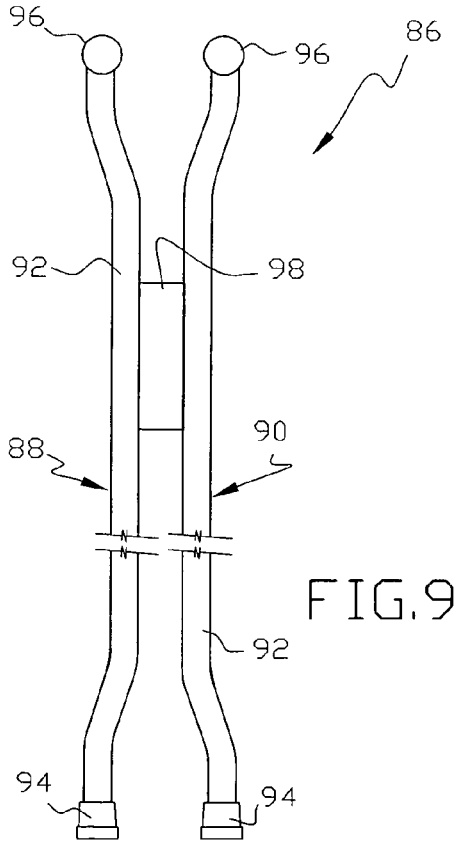
FIG. 9 is an end view illustrating another embodiment of this invention.

Referring to FIG. 9, another convertible cane 86 of this invention is illustrated comprising single canes 88, 90 which each include side-by-side upright supports 92 having a resilient padded foot 94 and a handle 96. A connector 98 releasably secures the canes 88, 90 together for use as a single cane or as two separate canes. The handles 96 are offset relative to each other so the user grasps only one handle while using the convertible cane 86 rather than grasping both handles as in the embodiments of FIGS. 1–8.

Figure 10:
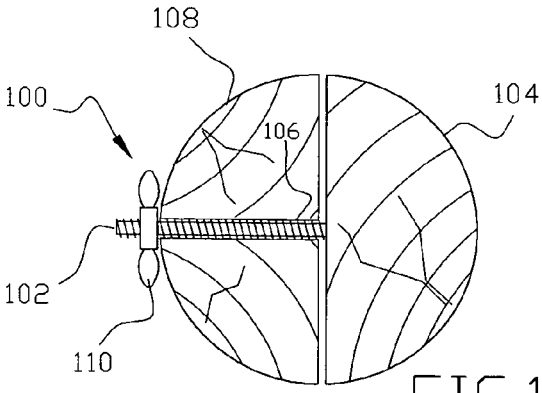
FIG. 10 is a cross-sectional view of a pair of side-by-side canes illustrating another feature of this invention.

It often happens that a cane user will know that there will be no need to use two canes and may wish to connect the canes in a more secure manner thereby preventing them from separating inadvertently. To this end, an additional secure connector may be provided. The secure connector 100 may be of any suitable type but is illustrated in FIG. 10 as a simple threaded fastener having a threaded shank 102 embedded in one of the canes 104 extending through a passage 106 in a second cane 108 and a wing nut 110 provided to receive the shank 102.

Referring to FIG. 11, there is shown another cane assembly 112 comprising a pair of canes 114, 116 having means (not shown) analogous to the pegs 28 and passages 26 for holding the canes 114, 116 together so long as there is no relative vertical movement between the canes 114, 116. The cane assembly 112 also comprises a mechanism 118 analogous to the device 30 for preventing relative vertical movement between the canes 114, 116. The mechanism 118 comprises a pair of aligned slots 120, 122 in the canes 114, 116 near the junction of the upright vertical support and the handle. A tab 124 is pivoted for movement about an axis 126 provided by a screw or pin (not shown). With the tab 124 in the position shown in FIG. 11, i.e. wholly within the confines of the slot 120, the canes 114, 116 are freed for relative vertical movement so the canes 114, 116 can be separated for individual use. To secure the canes 114, 116 together, they are placed in side-by-side relation and the tab 124 pivoted into the slot 122 whereby the canes 114, 116 are prevented from relative vertical movement and are thus connected together.

A further feature of the cane assembly 112 is an supplementary locking mechanism comprising a bolt 128. If the user decides that separate use of the canes 114, 116 will not be necessary, the tab 124 is pivoted into the slot 122 and the bolt 128 is passed through aligned openings 130, 132 preventing the tab 124 from pivoting to the position shown in FIG. 11. A nylon nut 134 in the bottom of the passage 132 provides sufficient friction to retain the bolt 128 in place. The bolt 128 preferably provides a head 136 that can be grasped between the thumb and forefinger for readily advancing the bolt 128 into the nylon nut 134. To provide a convenient storage location for the bolt 128, a storage passage 138 is provided in the handle 140 rearward of the slots 120, 122. The storage passage 138 also provides a nylon nut 140 for frictionally holding the bolt 128 so it will not be lost.

It will accordingly be seen that the convertible canes of this invention comprise two separately useable canes having exteriors which, in the configuration of a single cane, are side-by-side and the exteriors face each other.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A convertible walking aid comprising a pair of separate walking aids each having an upright support providing an exterior, a foot adjacent a lower end of the support and a handle to be grasped by a different hand of a user allowing the walking aids to be used separately and independently, the handles comprising an exterior, a long dimension for accommodating a width of a hand of the user and a short dimension providing a thickness of the handle, and a connector detachably securing the walking aids together in a position wherein the support exteriors, the handle exteriors and the long dimensions of the handles are in side-by-side juxtaposed relation so the walking aids, when secured together, can be used as a single device, and part of both handle exteriors, in the side-by-side position of the support exteriors, provide a combined handle for grasping by the user when the convertible walking aid is used as a single device.

2. The convertible walking aid of claim 1 wherein each foot comprises an resilient pad.

3. The convertible walking aid of claim 2 wherein the resilient pad is at least half of the cross-sectional area of the support.

4. The convertible walking aid of claim 1 wherein the feet, in the side-by-side position of the supports, provide a pair of flat surfaces defining a single plane thereby providing a combined foot for supporting the convertible walking aid when it is used as a single device.

5. The convertible walking aid of claim 1 wherein the handles are adjacent an upper end of the supports and, in the side-by-side position of the support exteriors, the supports being generally linear and lying in a common plane, the handles in the side-by-side position of the long dimensions thereof lie in the common plane.

6. The convertible walking aid of claim 5 wherein the combined handle provides a hand receiving section having a curved upper surface, the hand receiving section being not more than about 3" in width.

7. The convertible walking aid of claim 1 wherein the feet each comprise a rubber pad.

8. The convertible walking aid of claim 1 wherein the connector comprises a hook-and-loop fastener on the walking aids.

9. The convertible walking aid of claim 1 wherein the connector comprises a key hole slot on one of the canes and a headed pin on the other cane, friction between the pin and slot acting to resist relative vertical movement between the walking aids.

10. The convertible walking aids of claim 1 wherein the connector comprises a protuberance fixed to a first walking aid at an acute angle and a second cane provides a passage receiving the protuberance and further comprising a latch selectively preventing horizontal movement of the first and second walking aids.

11. The convertible walking aid of claim 1 wherein the connector comprises a slot on each of the walking aids which mate in the position wherein the support exteriors are in side-by-side relation and a pivoted tab for movement between a first position residing in both slots and a second position outside at least one of the slots.

12. The convertible walking aid of claim 1 wherein, in the side-by-side juxtaposed relation of the handles, the handle exteriors are parallel and abut.

13. A convertible walking aid comprising a pair of separate walking aids each having an upright support providing an exterior, a foot adjacent a lower end of the upright and a handle an upper end of the support allowing each handle to be grasped by a different hand of a user allowing the walking aids to be used separately and independently, the handles comprising an exterior, a long dimension for accommodating a width of a hand of the user and a short dimension providing a thickness of the handle, and a connector detachably securing the walking aids together in a position wherein the support exteriors, the handle exteriors and the long dimensions of the handles are in side-by-side juxtaposed relation so the walking aids, when secured together, can be used as a single device, the handles, in the side-by-side position of the support exteriors, are spaced apart and one of the handles provides a second handle for grasping by the user when the convertible walking aid is used as a single device.

14. A convertible cane assembly comprising a pair of walking canes each having an upright support providing an exterior, a foot adjacent a lower end of the support and a handle adjacent an upper end of the support allowing each handle to be grasped by a user's hand so the canes are useable separately and independently, the handles comprising an exterior, a long dimension for accommodating a width of a hand of the user and a short dimension providing a thickness of the handle, and a connector detachably securing the canes together in a side-by-side position where the support exteriors and part of the handle exteriors are in facing relation and the long dimension of the handles are in side-by-side juxtaposed relation so the assembly acts as a single cane and part of both handle exteriors, in the side-by-side position of the support exteriors, provide a combined handle for grasping by the user when the convertible walking cane is used as a single device.

15. The convertible cane assembly of claim 14 wherein the feet, in the side-by-side position of the support exteriors, provide a pair of flat surfaces defining a single plane and thereby provide a support for a user's load.

16. The convertible cane assembly of claim 14 wherein, in the side-by-side juxtaposed relation of the handles, the handle exteriors are parallel and abut.

17. A method of using a convertible walking aid of the type having a pair of walking aids each having an upright support providing an exterior, a foot adjacent a lower end of the support and a handle having an exterior, a long dimension accommodating a width of a hand of the user and a short dimension providing a thickness of the handle, adjacent an upper end of the support allowing each handle to be grasped by a different hand of a user, the method comprising attaching the walking aids in side-by-side relation where the support exteriors and the handle exteriors are in facing juxtaposed relation and the long dimension of the handles are in side-by-side juxtaposed relation to provide a single walking aid and then using the single walking aid by grasping and using the handle exteriors as a combined handle; and detaching the walking aids and using the walking aids separately and simultaneously.

* * * * *